US005513415A

United States Patent [19]

Kent et al.

[11] Patent Number: 5,513,415

[45] Date of Patent: May 7, 1996

[54] STEAM CLEANING DEVICE

[75] Inventors: Jerry R. Kent, Fresno, Calif.; John Kozul, St. Louis, Mo.; Edwin Fitzwater, Rahway, N.J.

[73] Assignee: Rug Doctor, L.P., Fresno, Calif.

[21] Appl. No.: 376,561

[22] Filed: Jan. 20, 1995

[51] Int. Cl.[6] ..... A47L 7/00

[52] U.S. Cl. ..... 15/320; 15/353; 15/410

[58] Field of Search ..... 15/320, 321, 322, 15/353, 410

[56] References Cited

U.S. PATENT DOCUMENTS

| | | | |
|---|---|---|---|
| 3,408,673 | 11/1968 | Oxel | 15/320 |
| 3,550,181 | 12/1970 | Dolan | 15/320 |
| 3,797,600 | 3/1974 | Miner | 15/320 |
| 3,896,520 | 7/1975 | Williams | 15/320 |
| 3,930,281 | 1/1976 | Principe et al. | 15/320 |
| 3,939,527 | 2/1976 | Jones | 15/353 |
| 3,940,826 | 3/1976 | Phillips et al. | 15/320 |
| 3,974,541 | 8/1976 | Silvis et al. | 15/320 |
| 4,023,233 | 5/1977 | Prestwich | 15/320 |
| 4,138,760 | 2/1979 | Cadle | 15/321 |
| 4,200,951 | 5/1980 | Burgoon | 15/321 |
| 4,317,252 | 3/1982 | Knowlton | 15/320 |
| 4,353,145 | 10/1982 | Woodford | 15/320 |
| 4,458,377 | 7/1984 | Frohbieter | 15/320 |
| 4,586,208 | 5/1986 | Trevarthen | 8/158 |
| 4,651,380 | 3/1987 | Ogden | 15/321 |
| 4,803,753 | 2/1989 | Palmer | 45/320 |
| 4,809,397 | 3/1989 | Jacobs | 15/320 |
| 4,934,017 | 6/1990 | Kent | 15/321 |
| 5,012,549 | 5/1991 | Williams et al. | 15/320 |
| 5,048,148 | 9/1991 | Gleadall | 15/321 |
| 5,146,647 | 9/1992 | Blase et al. | 15/321 |
| 5,155,876 | 10/1992 | Whitaker | 15/320 |
| 5,279,672 | 1/1994 | Betker | 15/320 |
| 5,287,587 | 2/1994 | Yonkers et al. | 15/320 |

FOREIGN PATENT DOCUMENTS

| | | | |
|---|---|---|---|
| 0286328 | 10/1988 | European Pat. Off. | 15/320 |
| 3445200 | 6/1986 | Germany | 15/321 |

*Primary Examiner*—David Scherbel
*Assistant Examiner*—Randall E. Chin
*Attorney, Agent, or Firm*—Grace J. Fishel

[57] ABSTRACT

A steam cleaning machine has a vacuum pump seated in a recess in a top of a main support housing and a first conduit resiliently sealed in a channel leading under the recess and connecting the first conduit with the air inlet of the pump. The first conduit passes through a vacuum cover which is fitted over the top of main support housing and is attached to a dome which is resiliently sealed to a recovery tank, while a second conduit is connected to the exhaust of the pump. A third conduit is connected to a vacuum nozzle, passes through vacuum cover and is also attached to the dome which is supported by first and third conduits from the vacuum cover. An adjustable handle is pivoted at the back of main support housing.

8 Claims, 6 Drawing Sheets

STEAM CLEANING DEVICE

BACKGROUND OF THE INVENTION

1. Field of the Invention

The present invention relates to a steam carpet and upholstery cleaning machine wherein the number and size of the parts have been reduced and wherein many of the parts serve several purposes.

2. Brief Description of the Prior Art

A steam cleaning machine for carpets typically includes a clean water tank and a recovery tank. A clean water hose joins the clean water tank to a pump and spray nozzle and a vacuum hose extends from a vacuum nozzle to the recovery tank. Water is pumped from the clean water tank and supplied to the spray nozzle and a large blower on the recovery tank generates suction whereby water sprayed onto the carpet is drawn through the vacuum nozzle and vacuum hose into the recovery tank. A brush for scrubbing the carpet may also be provided.

In older steam cleaners, the clean water tank and recovery tank were mounted on a first carriage and the spray nozzle and vacuum nozzle were mounted on a second carriage. More recently, carpet steam cleaners have mounted the spray nozzle and vacuum nozzle on the same carriage as the clean water tank and recovery tank. Such all-in-one machines are less bulky and cumbersome to transport and use, one such machine being sold by Rug Doctor, L.P. under the trademark EZ-1.

The EZ-1 has been redesigned, reducing the number and size of the parts and making them serve multiple purposes. The resulting machine has 25–30% fewer parts and is less expensive to manufacture because of materials reduction and because it is easier to assemble. The resulting machine is small, compact, well balanced and light weight, yet has better recovery efficiency than the older model. In addition, the equipment is much more maneuverable than the earlier two-piece steam cleaners or larger one-piece units in its ability to get under and around furniture without rearranging and disrupting the setting which allows the operator to concentrate on the task of cleaning the carpet.

The focus of this application regards a number of features that have been molded into a main support housing, resulting in a more efficient vacuum track, easier installation of a recovery tank and a fully adjustable handle. It also concerns a vacuum cover with a number of molded-in features, including a handhold that doubles as an air inlet for a cooling fan and apertures for a pair of vacuum hoses that support a dome sealed to the recovery tank.

SUMMARY OF THE INVENTION

In view of the above, it is an object of the present invention to provide a small, compact, well balanced, light weight all-in-one steam cleaning machine whose height, balance and collapsible handle make it so that it can be carried single handedly. It is another object to provide an all-in-one steam cleaning machine that has a more efficient vacuum track and better recovery efficiency. It is also an object to provide an all-in-one steam cleaning machine with fewer parts that is less expensive to manufacture. Other objects and features of the invention will be in part apparent and in part pointed out hereinafter.

In general terms, a steam cleaning machine in accordance with the present invention has a vacuum head mounted on a main support housing. A removable waste recovery tank is mounted under the vacuum head and is slidable in and out of the main support housing. A clean water tank has a top and a bottom with a spray nozzle for spraying water on a carpet, a water pump for pumping clean water from the clean water tank connected to the spray nozzle and a vacuum nozzle. The spray nozzle, water pump and vacuum nozzle are mounted under the clean water tank and the removable waste recovery tank and the main support housing are mounted on top of the clean water tank.

The vacuum head includes a vacuum pump and a vacuum cover. The vacuum pump has an impeller in an impeller housing with a bottom opening forming an air inlet to the vacuum pump. The main support housing has a top with a recess having a bottom and a sidewall. The vacuum pump is seated in the recess at its impeller housing and a channel in the bottom of the recess has a first end under the bottom opening in the impeller housing and a second end extending under the sidewall of the recess. A first conduit is resiliently sealed in the channel under the impeller housing, while a second conduit is connected to the exhaust of the vacuum pump. A third conduit is connected to the vacuum nozzle for drawing water sprayed on the carpet by the spray nozzle into the recovery tank with the first conduit being flowably connected to the third conduit in a dome sealed to the recovery tank.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
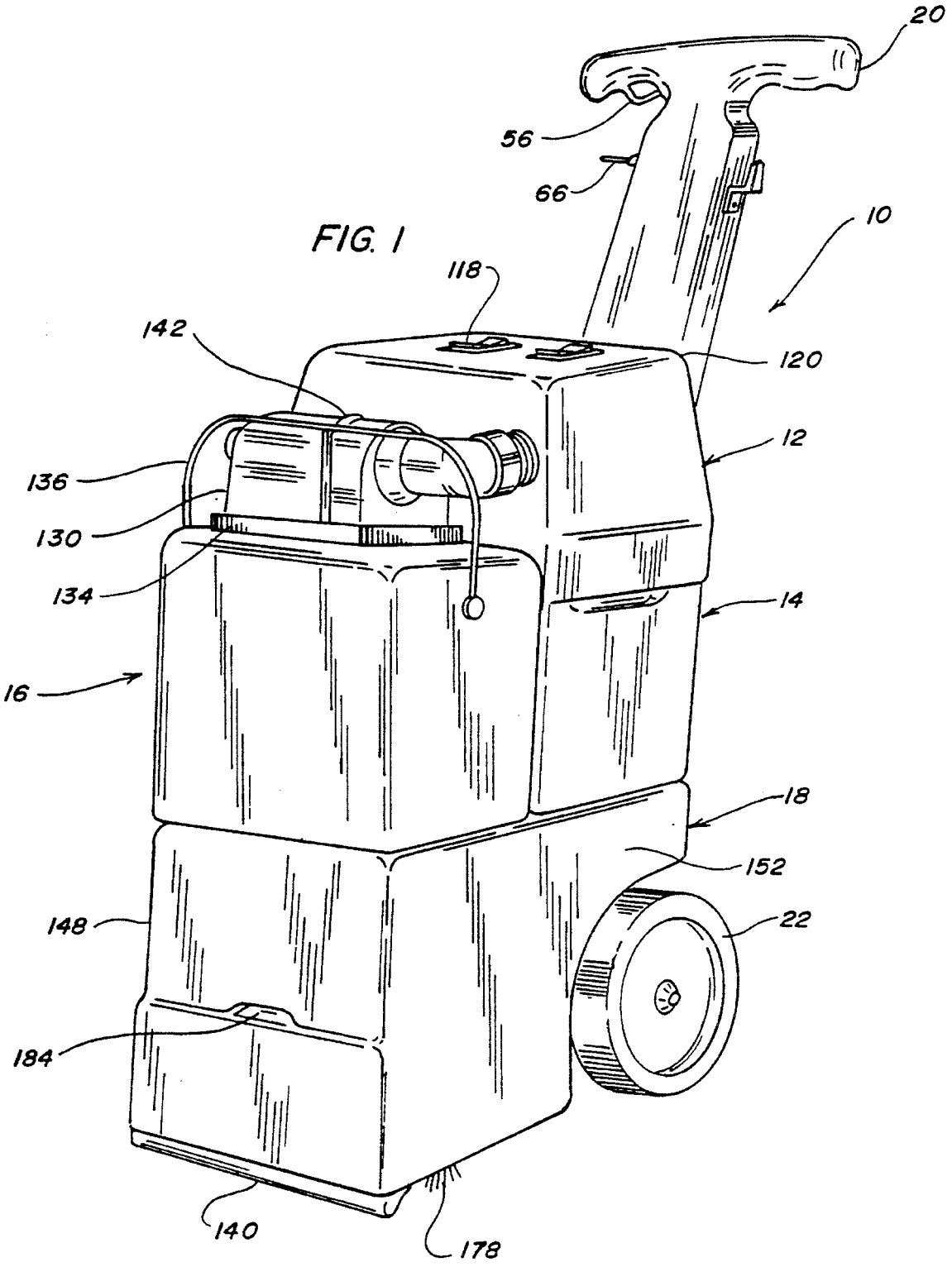
FIG. 1 is a perspective view of a steam cleaning machine in accordance with the present invention.
Figure 2:
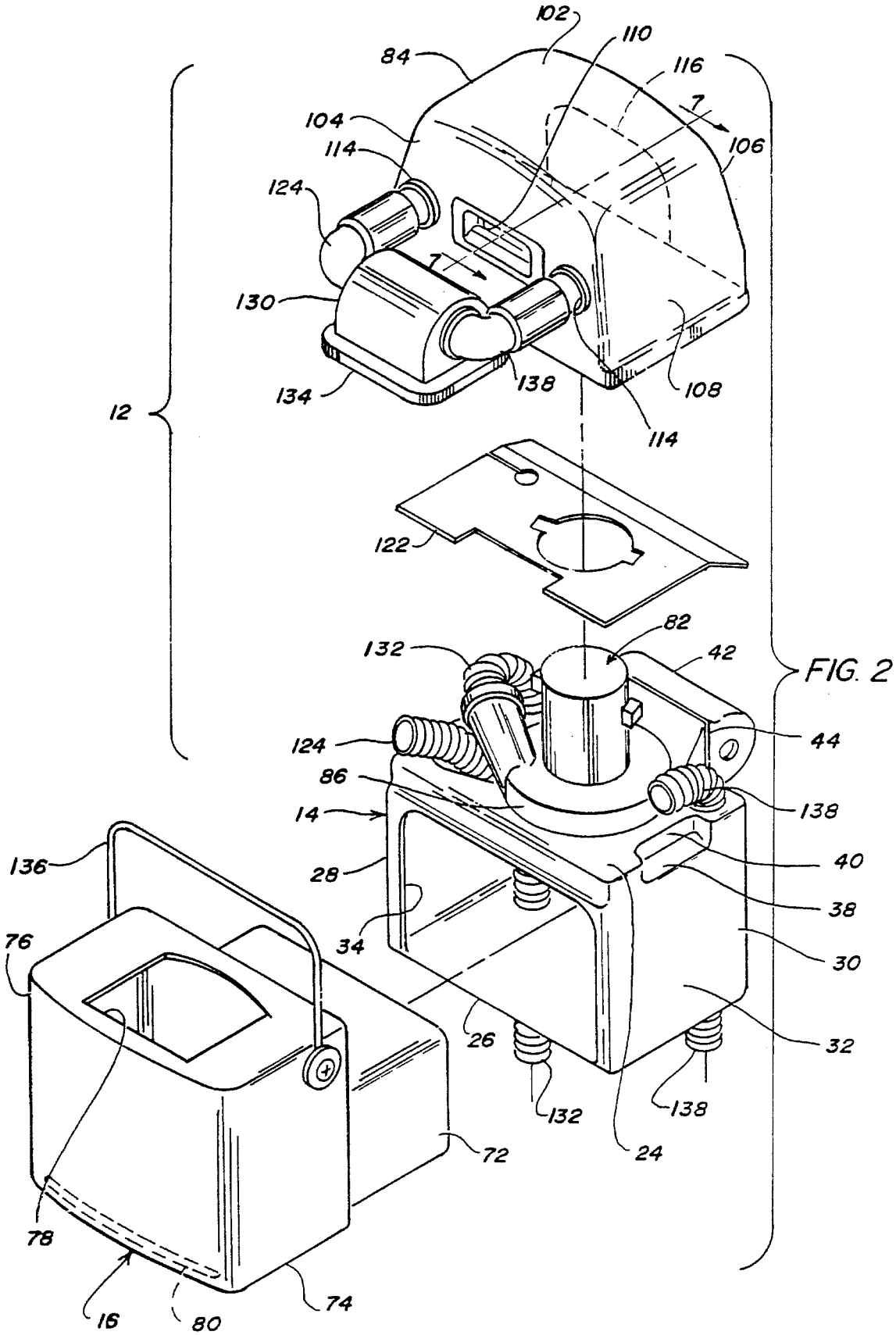
FIG. 2 is an exploded view of a vacuum head, main support housing and waste recovery tank.
Figure 3:
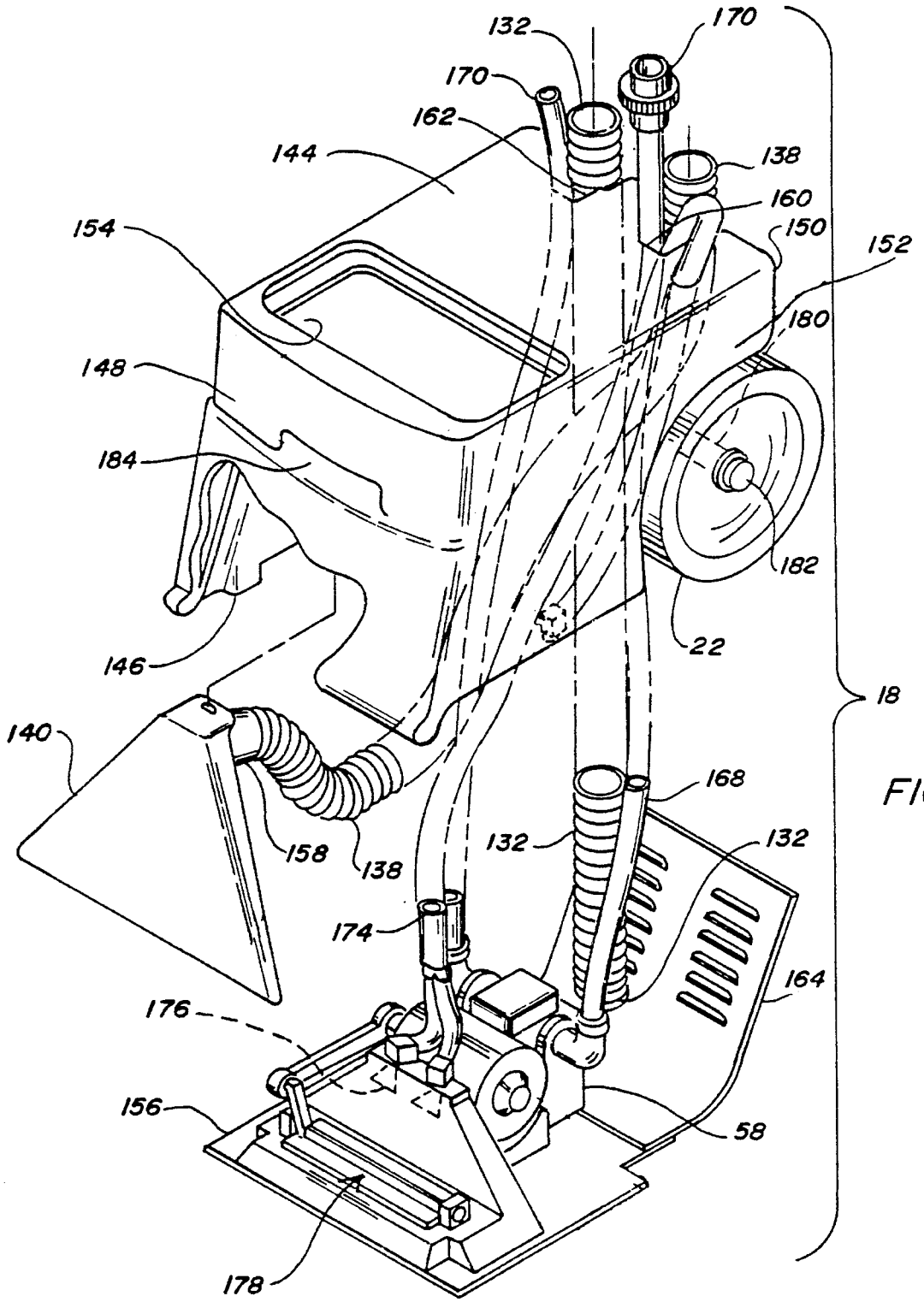
FIG. 3 is an exploded view of a clean water tank, vacuum nozzle, spray nozzle and vibratory brush assembly.
Figure 4:
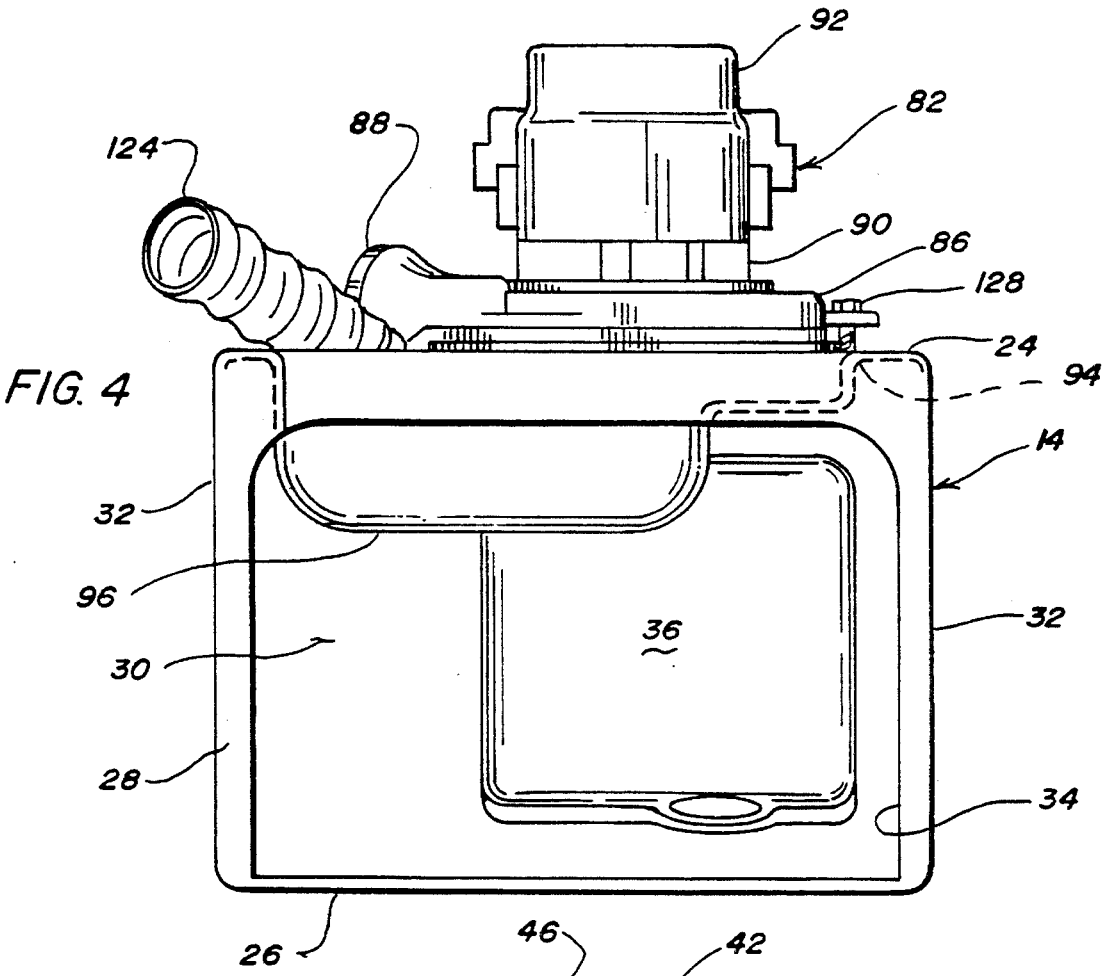
FIG. 4 is a front view of the main support housing and vacuum pump with the vacuum cover removed.
Figure 5:
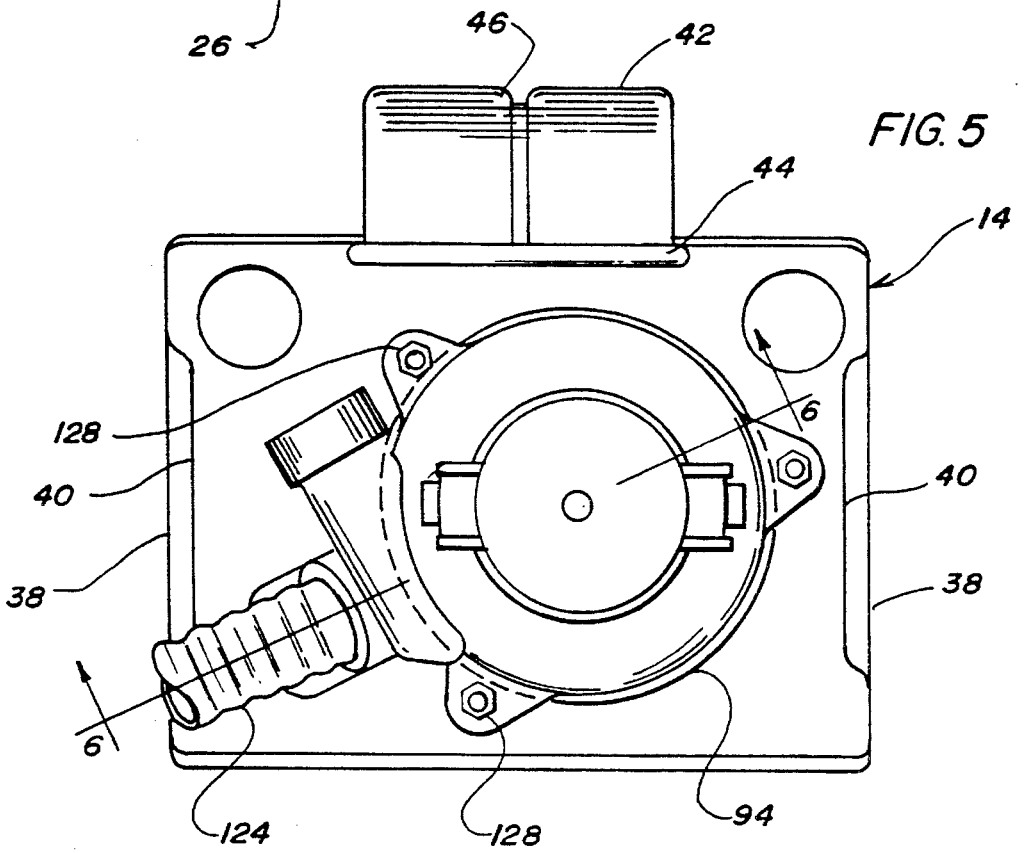
FIG. 5 is a top view of the main support housing and vacuum pump as shown in FIG. 4.
Figure 8:
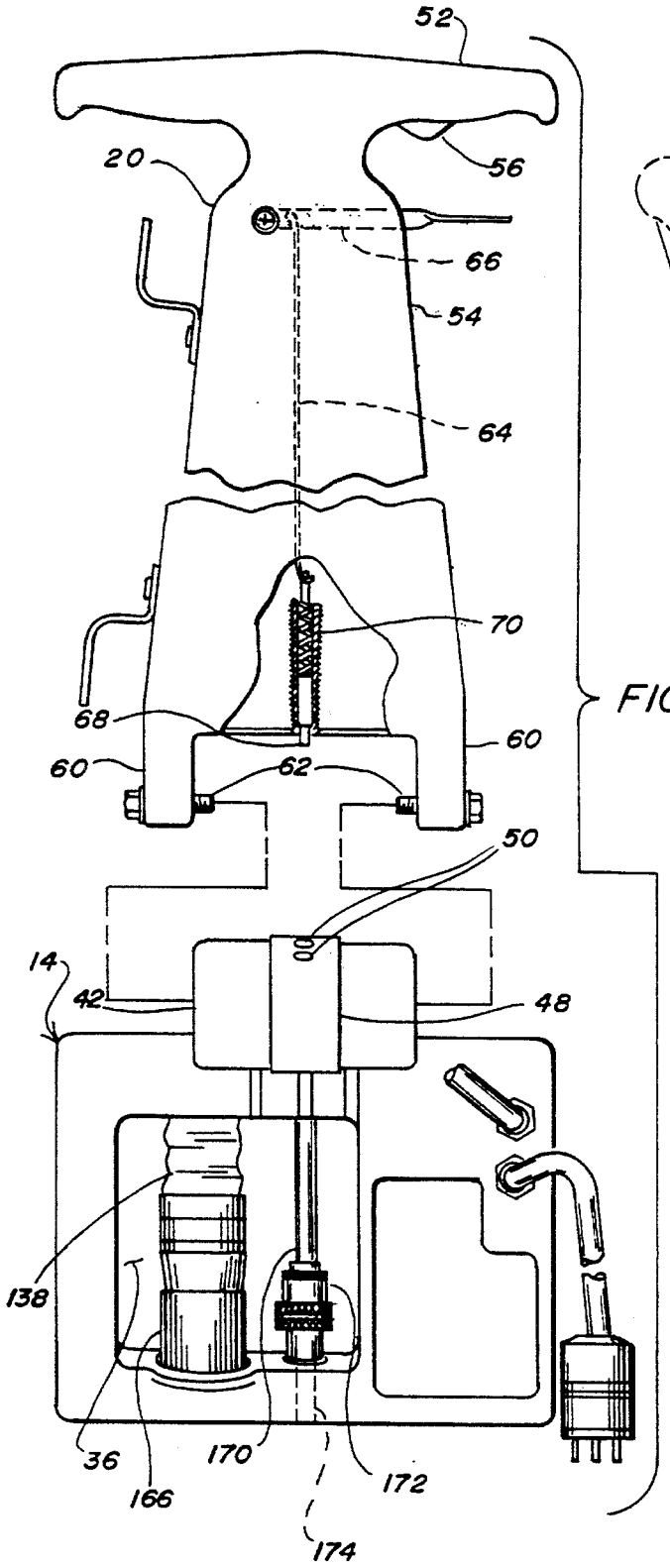
FIG. 8 is an exploded rear elevation of a T-shaped handle and the main support housing; and, FIG. 9 is a fragmentary side elevation of the T-shaped handle in three of various possible positions.
Figure 9:
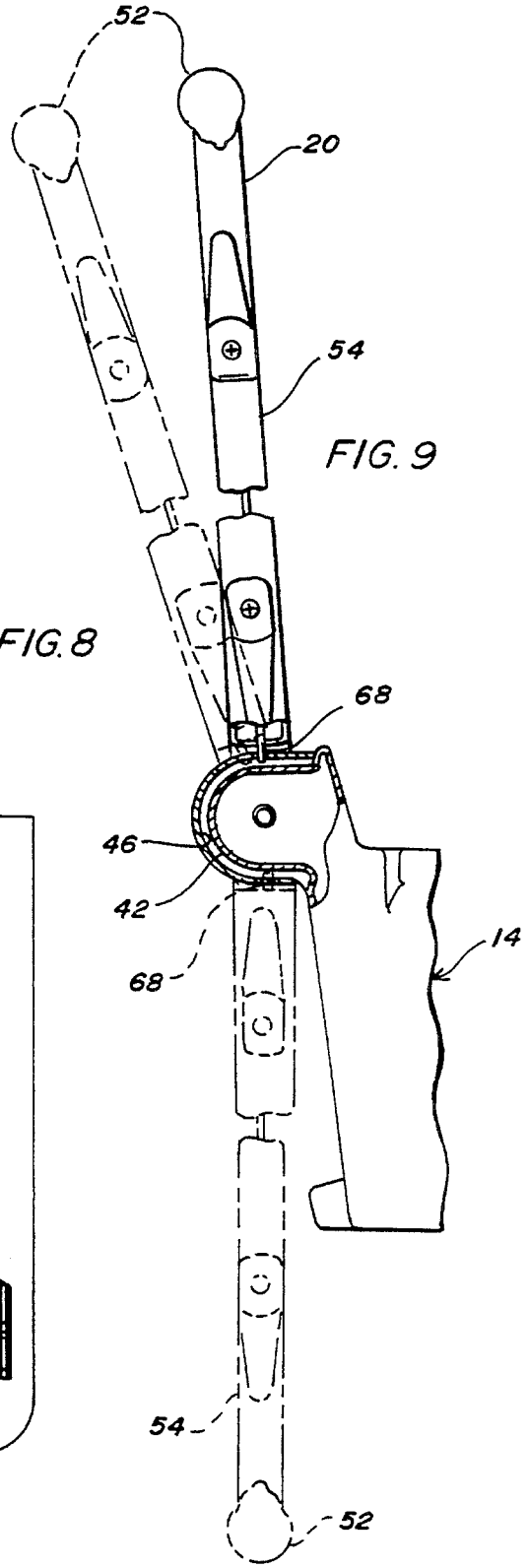
Figure 6:
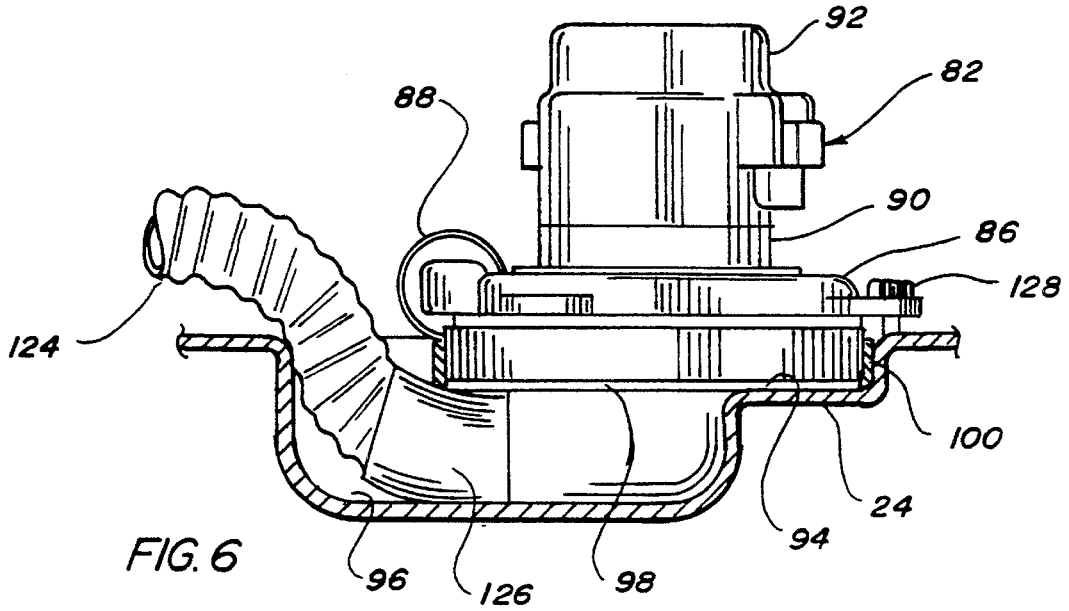
FIG. 6 is a section taken along line 6—6 in FIG. 5.
Figure 7:
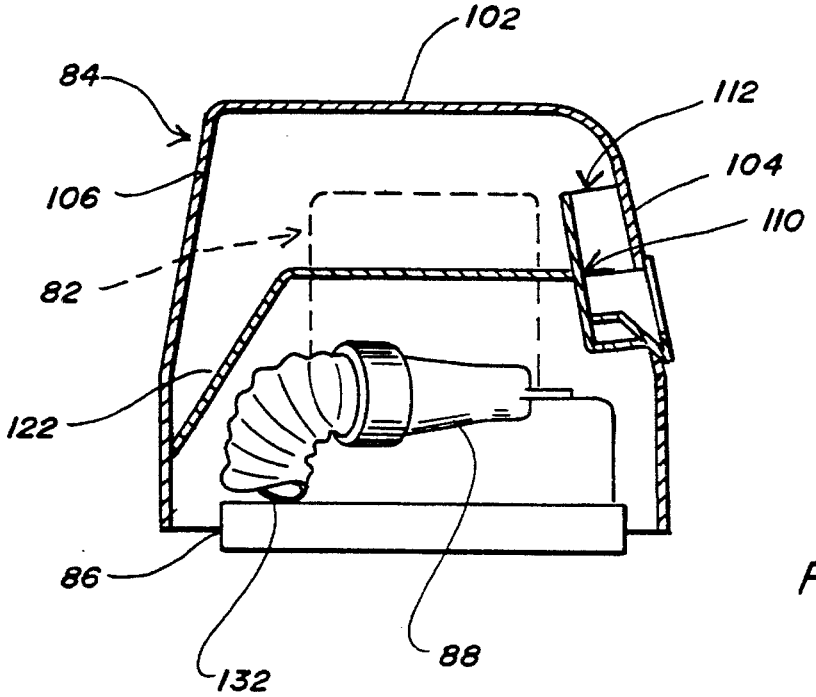
FIG. 7 is a section taken along line 7—7 in FIG. 2 of the vacuum cover with the vacuum pump shown in broken lines and other parts removed.

Referring to the drawings more particularly by reference character, reference numeral 10 refers to a portable self-contained carpet steam cleaning machine in accordance with the present invention. Steam cleaner 10 includes, vertically stacked, a vacuum head 12 mounted on a main support housing 14, a removable waste recovery tank 16 slidable in and out of the main support housing and a bottom clean water tank 18 upon which the main support housing and waste recovery tank are mounted. A handle 20 is pivotally attached to main support housing 14 at the rear of the machine for moving the machine on a pair of wheels 22 attached to the underside of clean water tank 18, which in addition to serving as a reservoir for premixed cleaning solution, serves as a chassis for the machine.

Main support housing 14 has a top 24, a bottom 26 and front, rear and lateral sidewalls 28, 30 and 32, respectively. A hole 34, framed on three sides, is provided in front sidewall 28, the frame formed by remaining portions of the front sidewall. A recess 36 is formed in rear sidewall 30 and a pair of recesses 38 are provided in lateral sidewalls 32, forming a notch 40 in top 24. A cylinder 42 is joined along a side edge to a flange 44 that extends upwardly from rear sidewall 30 and is angled slightly towards front sidewall 28. A groove 46 is formed in cylinder 42 midway the length thereof, about which is wrapped a plate 48 with a plurality of spaced apart apertures 50 positioned over the groove.

Handle 20 is T-shaped with a crossbar 52 mounted at one end of a stem 54 with the crossbar forming a pair of grips on opposite sides of the stem. A switch 56 for activating a water pump 58 is provided within fingertip reach on the right grip. Stem 54 widens and is bifurcated at its opposite end forming branches 60 which are journaled about a pair of bolts 62 attached to the ends of cylinder 42. Handle 20 has a rod 64 attached near crossbar 52 to a lever 66, one end of which is within fingertip reach of the right grip and the other end of which is pivoted on stem 54. An opposite end of rod 64 ends with a pin 68 which is received in one of apertures 50 in plate 48. Rod 64 is biased with a spring 70 such that pin 68 is extended except when lever 66 is pulled up. Depending on the arrangement of apertures 50, handle 20 can be adjusted between a vertically up and a vertically down position, and at selected angles therebetween.

Recovery tank 16 is boot-shaped, having a toe 72, a heel 74 and a cuff 76 which is partially closed at the top, leaving an aperture 78. Heel 74 has a ridge 80 on the bottom and toe 72 slides in and out of main support housing 14 through hole 34.

Vacuum head 12 includes a vacuum pump or motor 82 housed under a vacuum cover 84. Vacuum pump 82 is of the kind used for wet pickup and includes an impeller in an impeller housing 86 with a tangential discharge 88 and a bottom opening, driven by a motor 90 cooled with a cooling fan 92. Vacuum pump 82 is seated on its impeller housing in a recess 94 that is molded in top 24 of main support housing 14. The floor of recess 94 has a channel 96, a first end of which is under the bottom opening in impeller housing 86 and a second end of which extends under the sidewall of recess 94. An annular gasket 98 is attached to the bottom of impeller housing 86 and a band of gasket material 100 is attached around the outside of impeller housing 86, the gaskets providing a resilient seal between impeller housing 86 and recess 94.

Vacuum cover 84 has a top 102 and front, rear and lateral sidewalls 104, 106 and 108, respectively, and an open bottom, forming a skirt fitting over main support housing 14, attached with screws. A pocket handle 110 with an open top 112 is formed in front sidewall 104, flanked by a pair of apertures 114 for hoses, while a notch 116 is provided in rear sidewall 106 for flange 44. Top 102 is outfitted with a switch 118 for turning on vacuum pump 82 and a switch 120 for use in cleaning upholstery only. A baffle 122 collars fan 92 and divides the interior space of vacuum cover 84 into two chambers. Air is drawn through pocket handle 110 into the upper chamber by fan 92, used to cool the coils of motor 90 in lower chamber and then vented under the skirt of vacuum cover 84 through notches 40.

The air inlet of vacuum pump 82 is attached to a first conduit 124 wrapped with a strip of a gasket material 126 and press fit into channel 96 under the sidewall of recess 94, forming a resilient seal. The seal is maintained by a plurality of threaded fasteners 128, passing through ears provided in vacuum pump 82 and received in main support housing 14, which serve to clamp the vacuum pump in recess 94. First conduit 124 and the other conduits discussed below are preferably formed of fiberglass reinforced, steel wire supported vinyl to make the necessary twists and turns required by the compact design of steam cleaner 10.

From channel 96, first conduit 124 passes through one of apertures 114 in vacuum cover 84 and connects to one side of a dome 130, while the exhaust side of vacuum pump 82 is attached to a second conduit 132 that passes down the back of the machine. Dome 130 has a gasket 134 about its base and is sealed about aperture 78 in the top of recovery tank 16. The seal between dome 130 and recovery tank 16 is maintained by a bale 136 that doubles as a carrying handle for recovery tank 16. A third conduit 138 in communication with recovery tank 16 is attached to the other side of dome 130 and passes through the other one of apertures 114 in vacuum cover 84. Conduits 124 and 138 support dome 130 from vacuum cover 84. The vacuum in first conduit 124 is communicated through recovery tank 16 to third conduit 138, which passes down the back of the machine and is coupled to a vacuum nozzle 140 under clean water tank 18. Third conduit 138 is separated from first conduit 124 by a vertical partition 142 preventing the entry of water into the vacuum motor.

Clean water tank 18 has a top 144, a bottom 146 and front, rear and lateral sidewalls 148, 150 and 152, respectively. Top 144 includes an aperture 154 at the front of the tank for use in filling the tank with premixed cleaning solution. A pan 156 is attached to bottom 146 with screws. Front wall 148 of clean water tank 18 is slightly longer than lateral sidewalls 152 and is flared downwardly and forwardly so that the front end of machine 10 can be brought flush with the base of walls and furniture.

Vacuum nozzle 140 includes a pair of spaced triangular plates, joined on two sides and open on the bottom, the rear plate of which has a fitting 158 for attachment to third conduit 138. A notch 160 is provided in rear wall 150 for receipt of third conduit 138 and a second notch 162 is provided for receipt of second conduit 132 which is vented through a rear panel 164. Third conduit 138 can be accessed in recess 36 at the rear of main support housing 14 where it is provided with a coupling 166. Rear panel 164 is attached to pan 156 and rear wall 150 of clean water tank 18 with screws.

An inlet of water pump 58 is connected by a first tube 168 to a strainer in the bottom of clean water tank 18 and an outlet is connected by a second tube 170 to a male portion of a quick disconnect coupler 172 that is accessed in recess 36 at the rear of main support housing 14. A third tube 174 interconnects a female portion of coupler 172 and a spray nozzle 176. Water pump 58 and spray nozzle 176 are mounted on pan 156 and are fitted under clean water tank 18. A vibrating brush assembly 178 including a motor for oscillating a brush with a cam driven link may also be mounted on pan 156. Wheels 22 are mounted on a stationary axle 180 journaled in clean water tank 18 using a standard mounting arrangement with an axle cap 182. A hand hold 184 may also be molded into the outside of front wall 148 of clean water tank 18.

In use with switch 118 turned on and switch 56 depressed, as machine 10 is pulled rearwardly on wheels 22 by handle 20, premixed cleaning solution is drawn through strainer in clean water tank 18 through first tube 168 into the inlet of water pump 58. The cleaning solution is then forced from the outlet of water pump 58 into second tube 170 which mates with third tube 174 at coupler 172 and delivered under pressure to spray nozzle 176. Spray nozzle 176 directs a spray of the solution onto a carpet just behind vibratory brush assembly 178. The wetted carpet is given a brief scrubbing and the cleaning solution immediately recovered with vacuum nozzle 140. Spent cleaning solution is sucked through third conduit 138, into dome 130, where it is stopped by partition 142 and falls under gravity to the bottom of recovery tank 16. Quick disconnect coupler 172 and hose coupling 166 are provided for optional attachment of upholstery cleaning accessories, in which mode switch 120 is in the upholstery only mode, disabling vibrating brush 178. Cleaning solution is provided by connection to tube 170 and vacuum is applied by connection to third conduit 138.

Device 10 has a more efficient vacuum track because of the way in which first conduit 124 is connected to the face of vacuum pump 82. In the EZ-1, the impeller housing was attached to a metal pipe on which the vacuum hose was attached with a hose clamp. In the earlier model, the vacuum hose had a larger diameter than the metal pipe, resulting in a reduction of vacuum pressure supplied to the vacuum nozzle. In device 10, on the other hand, first conduit 124 is connected to the bottom of impeller housing by a plenum formed by channel 96 and the base of vacuum pump 82 with no loss of vacuum pressure. In addition, by making device 10 more compact, the distance between vacuum nozzle 140 and vacuum head 12 is shortened, reducing the length of the vacuum tract, which improves recovery efficiency (i.e., the amount of cleaning solution recovered from the carpet) while decreasing vacuum motor requirements.

Recovery tank 16 in device 10 is easier to install than was the recovery tank in the earlier model, which was sometimes mistakenly installed backwards in which condition the machine did not operate properly, giving rise to customer complaints. To remove recovery tank 16, bale 136 is released from dome 130 and the bucket lifted upwardly slightly, releasing ridge 80 on heel 74 from the lip of aperture 154 in clean water tank 18 and permitting the bucket to slide out of main support housing 14. Conventionally, the recovery tank is smaller than the clean water tank because all of the cleaning solution is never recovered. In device 10, however, recovery tank 16 is larger (e.g., approximately one-half gallon larger) than clean water tank 18, providing more space for foam, a by-product of the cleaning process, making it less likely to rise into dome 130 where it will be drawn into vacuum pump 82, possibly damaging motor 90. Recovery tank 16 is also better balanced about bale 136 so that the bucket can be carried without spilling, whether partially filled or full.

The angle of handle 20 is fully adjustable with lever 66, permitting the operator to adjust the handle to his or her height, allowing the machine to be pulled easily, such that the operator has less tendency to lift the machine on the rearward stroke, making the machine less tiring to use. The arrangement of the controls is also ergonomically correct with the switch on the crossbar and the switches on the vacuum cover within easy reach as is lever 66.

There is enough flexibility in conduits 124 and 138 that dome 130 does not have to be rotated out of the way when recovery tank 16 is removed. Dome 130 is therefore in position ready to be sealed about aperture 78 when recovery tank 16 is reinstalled, ensuring a good seal when bale 136 is brought back over dome 130 even when device 10 is being operated by a novice.

In the earlier model, a plurality of vent holes were provided in vacuum cover for fan 92. By eliminating the vent holes, motor 90 is made splash-proof, air being drawn through pocket handle 110, about which device is balanced. With handle 20 collapsed, steam cleaning machine 10 can be carried single handedly by pocket handle 110, about which it is balanced, with a straight arm and a straight back by most operators.

It will be apparent from the above description that many of the parts in machine 10 serve multiple purposes, reducing assembly time and materials cost. The weight of the machine is reduced, while balance and maneuverability improved.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A cleaning machine comprising a vacuum head mounted on a main support housing, a removable waste recovery tank mounted under the vacuum head and slidable in and out of the main support housing, a clean water tank having a top and a bottom, a spray nozzle connected to the clean water tank for spraying water on a carpet, a water pump for pumping clean water from the clean water tank to the spray nozzle, and a vacuum nozzle, said spray nozzle, water pump and vacuum nozzle mounted under said clean water tank, and said removable waste recovery tank and main support housing mounted on top of the clean water tank, said vacuum head including a vacuum pump and a vacuum cover said vacuum pump having an air inlet and exhaust, said vacuum pump having an impeller housing having an impeller therein, said impeller housing having a bottom opening forming the air inlet to the vacuum pump, and said main support housing having a top with a recess, said recess having a bottom and a sidewall and said vacuum pump seated in the recess at its impeller housing, a channel formed in the bottom of the recess with a first end of said channel under the bottom opening in the impeller housing and a second end of said channel extending under the sidewall of the recess, a first conduit connected to the air inlet of the vacuum pump resiliently sealed in the channel under the impeller housing, a second conduit connected to the exhaust of the vacuum pump, a third conduit connected to the vacuum nozzle for drawing water sprayed on the carpet by the spray nozzle into the recovery tank, said first conduit flowably connected to said third conduit through a dome sealed to the recovery tank.

2. The cleaning machine of claim 1 wherein the vacuum cover has a front sidewall and an open bottom forming a skirt fitting over and being attached to the top of the main support housing, said first and third conduits passing through the front sidewall of the vacuum cover.

3. The cleaning machine of claim 1 wherein the main support housing has a back sidewall and a flange extending upwardly from the back sidewall, a cylinder having ends is mounted horizontally on said flange, a T-shaped handle, having a stem with a crossbar at one end of said stem and two branches at its opposite end, said handle pivoted by the branches which are connected to the ends of said cylinder.

4. The cleaning machine of claim 3 wherein the cylinder has apertures and the handle has a rod mounted on the stem with a pin at one end of said rod such that said pin is receivable in one of said apertures and locks the handle at a selected angle, whereby the handle has multiple operating positions, permitting various operators to find a comfortable operating position.

5. A cleaning machine comprising a vacuum head mounted on a main support housing, a removable waste recovery tank mounted under the vacuum head and slidable in and out of the main support housing, a clean water tank having a top and a bottom, a spray nozzle connected to the clean water tank for spraying water on a carpet, a water pump for pumping clean water from the clean water tank to the spray nozzle, and a vacuum nozzle, said spray nozzle, water pump and vacuum nozzle mounted under said clean water tank, and said removable waste recovery tank and main support housing mounted on top of the clean water tank, said vacuum head including a vacuum pump and a vacuum cover said vacuum pump having an air inlet and exhaust, said vacuum pump having an impeller housing having an impeller therein, said impeller housing having a bottom opening forming the air inlet to the vacuum pump, and said main support housing having a top, bottom, front, back and lateral sidewalls, at least one of said sidewalls having a recess extending into said top and forming a notch, said top having a recess, said recess having a bottom and a sidewall and said vacuum pump seated and resiliently sealed in the recess at its impeller housing, a channel formed in the bottom of the recess with a first end of said channel under the bottom opening in the impeller housing and a second end of said channel extending under the sidewall of the recess, a first conduit connected to the air inlet of the vacuum pump resiliently sealed in the channel under the impeller housing, a second conduit connected to the exhaust of the vacuum pump, a third conduit connected to the vacuum nozzle for drawing water sprayed on the carpet by the spray nozzle into the recovery tank, said first conduit flowably connected to said third conduit through a dome sealed to the recovery tank, said vacuum cover having a front sidewall and an open bottom forming a skirt fitting over and being attached to the top of the main support housing, said first and third conduits passing through the front sidewall of the vacuum cover and supporting the dome.

6. The cleaning machine of claim 5 wherein the vacuum pump further includes a cooling fan, and the center of the front side wall of the vacuum cover has a pocket handle formed therein with an open top, and a baffle collars the cooling fan and divides the interior of the vacuum cover into upper and lower chambers, whereby air is drawn through the open top of the pocket handle by the cooling fan in the upper chamber and vented under the skirt of the vacuum cover through the notch in the main support housing in the lower chamber and wherein the machine can further be carried single handedly by the pocket handle.

7. The cleaning machine of claim 5 wherein a flange extends upwardly from the back sidewall of the main support housing, a cylinder having ends is mounted horizontally on said flange and a T-shaped handle has a stem with a crossbar at one end of said stem and two branches at its opposite end, said handle being pivoted by the branches which are connected to the ends of said cylinder.

8. The cleaning machine of claim 7 wherein the cylinder has apertures and the handle has a rod mounted on the stem with a lever attached at a first end of said rod for reciprocating the rod and a pin at a second end of said rod such that said pin is receivable in one of said apertures and locks the handle at a selected angle, whereby the handle has multiple operating positions, permitting various operators to find a comfortable operating position.

* * * * *